US008162458B2

(12) United States Patent
Muhl

(10) Patent No.: US 8,162,458 B2
(45) Date of Patent: Apr. 24, 2012

(54) INKJET PRINTING SYSTEM WITH AT LEAST ONE INK CARTRIDGE AND AN ASSOCIATED INK CARTRIDGE RECEPTACLE

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 412 days.

(21) Appl. No.: 12/427,038

(22) Filed: Apr. 21, 2009

(65) Prior Publication Data

US 2009/0322837 A1 Dec. 31, 2009

(30) Foreign Application Priority Data

Jun. 27, 2008 (DE) ..... 10 2008 030 530

(51) Int. Cl.
*B41J 2/175* (2006.01)

(52) U.S. Cl. ..... 347/86; 347/85

(58) Field of Classification Search ..... None
See application file for complete search history.

(56) References Cited

U.S. PATENT DOCUMENTS

| | | | | |
|---|---|---|---|---|
| 5,617,128 | A | 4/1997 | Thoman et al. | |
| 5,901,644 | A | 5/1999 | Etheridge et al. | |
| 6,102,534 | A | 8/2000 | Herbert | |
| 6,302,535 | B1 * | 10/2001 | Sturgeon et al. | 347/86 |
| 6,312,105 | B1 | 11/2001 | Miyauchi | |
| 6,585,347 | B1 * | 7/2003 | Johnson et al. | 347/22 |
| 6,886,913 | B2 * | 5/2005 | Nishiberi | 347/50 |
| 2001/0026300 | A1 | 10/2001 | Yamaguchi et al. | |
| 2003/0170064 | A1 | 9/2003 | Hetzer et al. | |
| 2004/0135857 | A1 | 7/2004 | Hashii et al. | |
| 2006/0256172 | A1 | 11/2006 | Kobayashi | |
| 2008/0018705 | A1 * | 1/2008 | Muhl | 347/49 |
| 2009/0160918 | A1 * | 6/2009 | Sugahara | 347/86 |

* cited by examiner

*Primary Examiner* — Matthew Luu
*Assistant Examiner* — Renee I Wilson
(74) *Attorney, Agent, or Firm* — Schiff Hardin LLP

(57) ABSTRACT

Inkjet printing system with at least one ink cartridge and an associated ink cartridge receptacle in which a special ink cartridge exchange device can be omitted, wherein the ink cartridge is modified by a guide pin that is fastened on the convexity of the ink cartridge, or between convexity and top of said ink cartridge, and projects only to one side beyond the flat side wall for the purpose of guiding the ink cartridge, and slides along in a wall of the ink cartridge receptacle; wherein, given an inserted ink cartridge, a leaf spring is pre-tensioned in each cavity of the cartridge receptacle of the ink cartridge receptacle that is provided for an ink cartridge; and via elastic force the exchange of the ink cartridge is assisted when the locking nose and the locking element of the ink cartridge receptacle disengage via manual pressure; and the ink cartridge is pivoted on an axis running near and parallel to the guide pin in order to release the ink cartridge; wherein the separation of the lower rear edge of the ink cartridge to the contact panel of the cartridge carrier is precisely defined by the curve of the guide link.

6 Claims, 8 Drawing Sheets

INKJET PRINTING SYSTEM WITH AT LEAST ONE INK CARTRIDGE AND AN ASSOCIATED INK CARTRIDGE RECEPTACLE

BACKGROUND OF THE INVENTION

1. Field of the Invention

The present invention concerns an inkjet printing system with at least one ink cartridge and an associated ink cartridge receptacle. The ink cartridge can be easily exchanged without an ink cartridge exchange device and is suitable for all inkjet printing devices, both those that operate with a moving inkjet print head and those with an unmoving inkjet print head during the printing.

2. Description of the Prior Art

The known inkjet printing systems differ in the means for generation of a relative movement between the print item and the inkjet print head. In contrast to conventional printers, in franking machines often only the inkjet print head together with its receptacle is moved, and the print item remains unmoving during the printing, or the print item is moved and the inkjet print head is stationary, i.e. remains unmoving in a printing position during the printing.

As used herein, a print item encompasses flat articles to be printed such as mail pieces, letter envelopes, postcards, chip cards, admission cards [tickets], bands and other substrates for printed information.

A secure printing apparatus with a removable print head is known from the European patent application EP 875 861 A2, with which printing apparatus a franking imprint is only possible when a hatch is closed. The latter can be opened only if the print head was shifted into a region adjacent to the printing position, i.e. when the printing module has arrived in an exchange position. The print head is integrated into an ink cartridge and installed in a printing module. The access to the ink cartridges of the printing module in the exchange position ensues from the outside via a flap whose position is interrogated by a microswitch. If the printing module is located in the exchange position, no access to the data lines is possible.

A secure printing apparatus with a removal print head is known from the European patent application EP 881 086 B1. This printing apparatus is equipped with: electrical connection means which establish a connection to the electrical contacts of the ink cartridges, wherein the later are installed at the printing module that was moved into the printing station; and with localization means to localize the printing module in a park (exchange) station in which the electrical connection means no longer engage with the electrical contacts, and wherein the printing module in the park (exchange) station can be removed by a user; as well as with insulation means to insulate the park (exchange) station from the electrical connection means.

An arrangement to exchange inkjet printing modules was proposed in the European patent application EP 1 880 857 A2, wherein two ink cartridges are designated with the last term, which two ink cartridges—in contrast to the solutions cited above—do not still need to be completed with an exchangeable printing module, in that they are arranged in an additional housing. Rather, the two ink cartridges are inserted directly into a receptacle of the pivot device. The latter is pivoted together with the inserted ink cartridges, whereby in contrast to the aforementioned solutions their print heads do not shift from the printing position into an exchange position but rather are pivoted. The exchange arrangement is used in the franking machine of the Centormail® type from the manufacturer Francotyp Postalia GmbH and has additional differences relative to the aforementioned solutions: in the exchange position, the electrical contracts are connected to the ink cartridges, and in the exchange position there are no means that detach the electrical contacts of the print head beforehand for removal of the ink cartridges or insulate the printing device in the park position before the ink cartridges are exchanged.

The arrangement has bars to lock the ink cartridges and, per ink cartridge, a draw hook mechanically connected with a return spring as well as a guide lever. This device for changing the ink cartridges that is attached to the ink cartridge receptacle is, on the one hand, materially intensive and can hardly satisfactorily solve a problem that is apparent using FIG. 9 of EP 1 880 857 A2: because the lower rear edge of the nozzle face rests on an elastic part which should prevent a contacting of the counterpart with the contact panel, the separation is small. Therefore, in the removal of the ink cartridge, the elastic parts and the contacts can nevertheless be contaminated by ink that has collected on the lower rear edge during the printing.

SUMMARY OF THE INVENTION

An object of the invention is to provide an inkjet printing system with at least one ink cartridge and an associated ink cartridge receptacle which does not exhibit the aforementioned disadvantages of the ink cartridge exchange device, that reduces the probability of a contamination of the contacts by enlarging the separation of the ink cartridge from the contacts during exchange, and thereby enables a protection from product piracy in an uncomplicated manner.

The above object is achieved by an ink cartridge of the type described above that is provided in accordance with the invention with a guide pin is fastened on the convexity of the ink cartridge, or between convexity and top (non-positive and positive connection). The pin terminates with the one flat side wall of the ink cartridge and protrudes on the opposite side beyond the flat side wall for the purpose of guiding the ink cartridge.

The ink cartridge receptacle is bilocular (has two chambers), with shaft-shaped cavities arranged offset to one another in a carrier, and is designed with external walls with identical shape. The outer walls and the middle wall of the cartridge carrier of the ink cartridge receptacle possess on one side a guide link in which the guide pin of an ink cartridge slides along.

A leaf spring in each of the cavities of the cartridge carrier of the ink cartridge receptacle that are provided for an ink cartridge is pre-stressed given an inserted ink cartridge and assists in the exchange of the ink cartridge by elastic force. For this purpose, the latter is moved counter to the elastic force (via manual pressure on the grip element opposite the locking nose) and pivoted on an axis running near and parallel to the guide pin (advantageously through said guide pin) in order to unlock the ink cartridge. The locking nose and the locking element of the ink cartridge carrier disengage. Driven by the elastic force of the leaf spring, the guide pin travels along in the guide link, wherein the separation of the lower rear edge of the ink cartridge from the contact panel of the ink cartridge is precisely defined by the course of the guide link. A greater reliability of the device and the assurance that the contacts cannot be smeared or mechanically damaged advantageously results.

A material savings also results, in particular relative to the receptacle of the franking machine according to EP 1 880 857 A2 of the Centormail® type by the manufacturer Francotyp Postalia GmbH, since bars, return springs, draw hooks and guide levers as well as stripper elements of the cartridge exchange device can be omitted.

DESCRIPTION OF THE PREFERRED EMBODIMENTS

Figure 1:
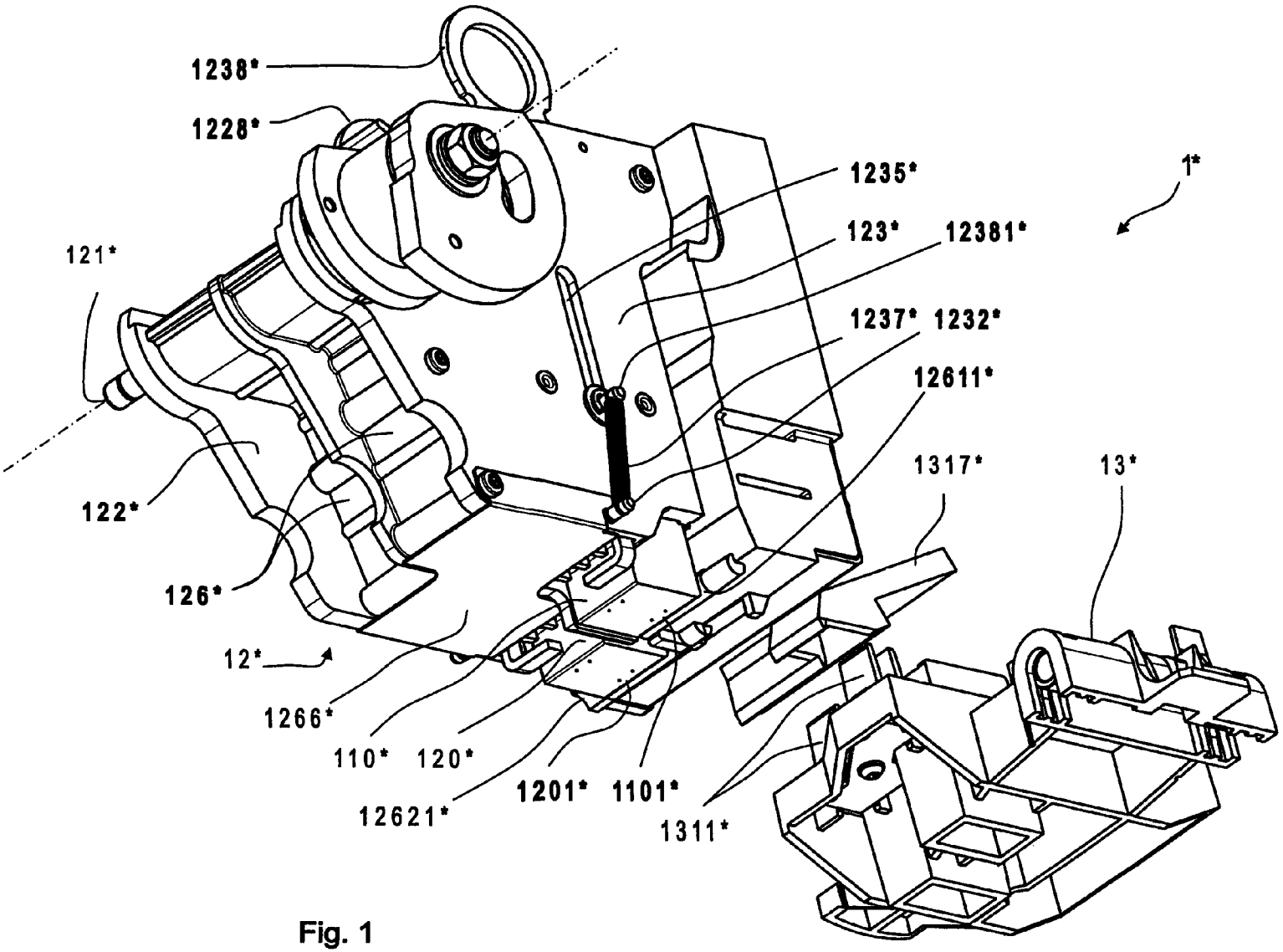
FIG. 1 is a perspective view of the known printing device with an ink cartridge with an ink cartridge receptacle in the franking machine of the Centormail® type.

A perspective view of the known printing device 1* of the franking machine of the Centormail® type from the front lower right is shown in FIG. 1. An ink cartridge receptacle 12* carries two inkjet print heads 110*, 120* and is shown pivoted on an axis 121* into a cleaning position. A cleaning and sealing device (RDS) 13* that bears wiper elements 1311* has been moved into a starting position in the rear part of the franking machine. A stripper mount 1317* is arranged between the RDS 13* and the print head receptacle 12*. The stripper mount carries strippers on its downward facing edges, at which strippers the stripped ink initially drips down. To clean the inkjet print heads 110*, 120*, the RDS 13* and [sic] is driven up to the ink cartridge receptacle 12 and is then moved back into the starting position. An ink residue thus remains on the print head edge 1101* and 1201*. Each inkjet print head is a component of an ink cartridge. Given a removal of the ink cartridges, this ink residue could contaminate the electrical contacts (not shown) inside the ink cartridge receptacle 12*. Therefore stripper elements 12611* and 12621* for the print head edge 1101* and 1201* are provided per opening at the edge on the floor of the ink cartridge receptacle 12*, through which stripper elements 12611* and 12621* each of the two inkjet print heads 110*, 120* protrudes. Each opening is bounded on one side by a base plate 1266* of the carrier 126* to the front and laterally by two side walls 122*, 123* to the rear, where the aforementioned electrical contacts are situated in the docking wall. Each ink cartridge is plugged into a shaft-shaped cavity of the ink cartridge receptacle 12* that are not each visibly equipped with a bar for the affixing of said ink cartridge receptacles 12*. Each ink cartridge bears means for supplying ink to the inkjet print head, a locking nose and a chip on the one narrow side, as well as a contact panel (not visible).

The ink cartridge receptacle 12* has means in the form of draw hooks 1228*, 1238* for drawing and, on the ink cartridge, means in the form of guide webs at the chip mount of the aforementioned chip as well as, in the print head receptacle 12*, means (not visible) in the form of a spring pin and a spring part for disconnecting the ink cartridge. The spring pin and a spring part are mechanically coupled with one another so they are already disconnected before initiation of the of the pulling process. The draw hooks 1228* and 1238* are retracted into the starting position by tension springs 1227*(not visible) and 1237*. The tension springs 1227*(not visible) and 1237* are tensioned between pins 1222*(not visible), 1232* on the floor of the carrier 126* and pins 12281*(not visible), 12381* that are attached in the middle of the draw hook and each protrude through an opening 1225* (not visible) or 1235* of the side walls 122* or 123*.

A stripper device 12611*, 12621* is arranged in the pivot region of the rear edge 1101* of the inkjet print head 110*.

The ink cartridge receptacle 12* is pivotable into a printing position so that both inkjet print heads are arranged stationary in a printing window of a guide plate for flat mail pieces (printing media) during the printing.

Figure 2A:
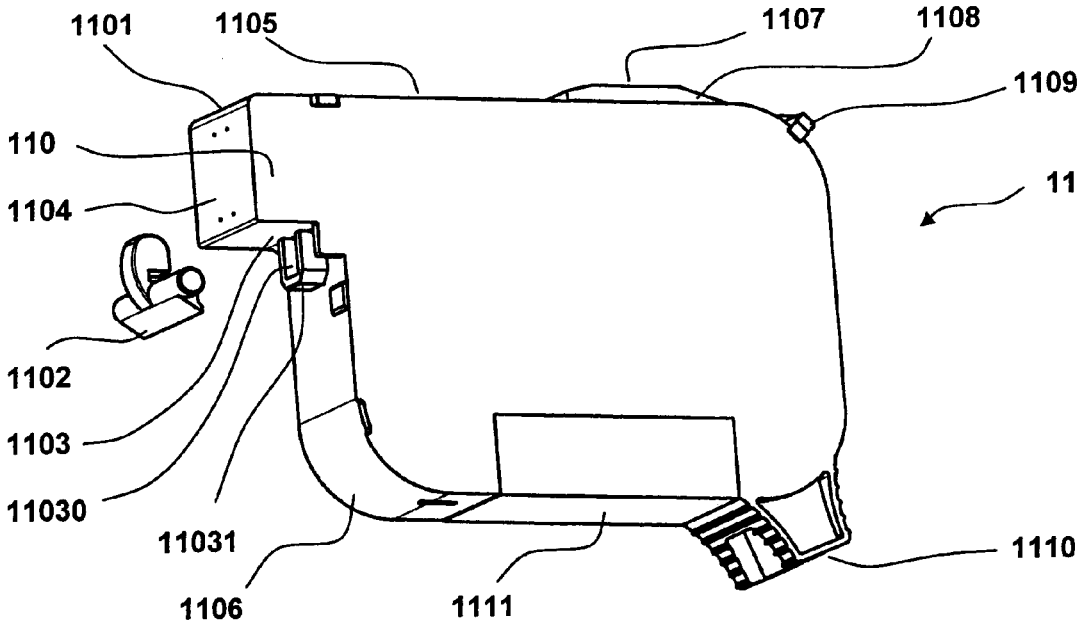
FIG. 2*a* is a perspective view, from the front lower left, of a modified HP ink cartridge that has been rotated 90° to the right.

FIG. 2*a* shows a perspective view of a modified ½ inch HP ink cartridge from the front lower left, wherein the oscillating circuit is shown rotated 90° to the right. The ink cartridge 11 fits in the shown (in FIG. 1) print head receptacle of the known printing device of the franking machine of the Centormail® type, however is hidden there by the print head receptacle and is not visible.

The HP ink cartridge 11 has two large-area side walls, of which only the left side wall is visible, meaning that that side wall is shown which is situated to the left in the ink cartridge receptacle shown (in FIG. 1) after the insertion of the HP ink cartridge. The other relative specifications (such as front and bottom) also orient on the shown ink cartridge receptacle. The ink cartridge has a convexity 1106 on one of the narrow sides and is inserted into the shown (in FIG. 1) ink cartridge receptacle with the convex side forward and with the print head 110 downward. The ink cartridge 11 has an electronic semiconductor chip (not visible) in the print head 110 that sits on a neck 1103. The head has a nozzle plate 1104 on its facing side (i.e. in the ink discharge direction), which nozzle plate 1104 transitions orthogonal to this into a narrow and short neck side 1103. The head has a parallel interface with an electrical contacting unit 1105 orthogonal to the nozzle plate 1104 on the narrow back side, which interface serves to control the inkjet print head. An edge 1101 of the print head 110 lies between the nozzle plate 1104 and the narrow back side with the contacting unit 1105. A chip mount 1108 with a chip 1107 is arranged on the narrow back side above the contacting unit 1105. The narrow back side transitions above into a narrow top side. A locking nose 1109 is arranged at the transition. The narrow top side transitions above into a narrow front side. A grip element 1110 is arranged at the transition. The narrow front side and, in part, the two large-area side walls of the HP ink cartridge 11 can be bonded with an adhesive label 1111. The ink cartridge 11 has a convex ink reservoir 1106 as an ink storage. The narrow front side transitions below into a narrow convexity underside. A convexity 1106 located at the transition is rounded. The narrow convexity underside transitions into the narrow neck side 1103, and a compartment 11030 with a stop 11031 is molded at the transition, wherein the compartment is narrower than the narrow convex side. Moreover, a guide pin 1102 is shown before the installation on the convex underside of the ink cartridge 11. After its installation the ink cartridge 11 no longer fits into the ink cartridge receptacle that was shown in FIG. 1. The chip mount 1108 on the narrow back side and the guide pin 1102 on the convex side of the HP ink cartridge 11 form a mechanical means for preventing an insertion of commercially available ink cartridges that are not authorized for this by the manufacturer of the printing device into an ink cartridge receptacle.

Corresponding to these electronic and mechanical prevention means 1107 and 1108, a control and contacting unit is arranged in the carrier of the ink cartridge receptacle for electronic signal conversion and mechanical connection with the ½ inch ink cartridge. A correspondingly modified carrier of the ink cartridge receptacle is explained in detail further below using FIGS. 3 and 4.

Figure 2B:
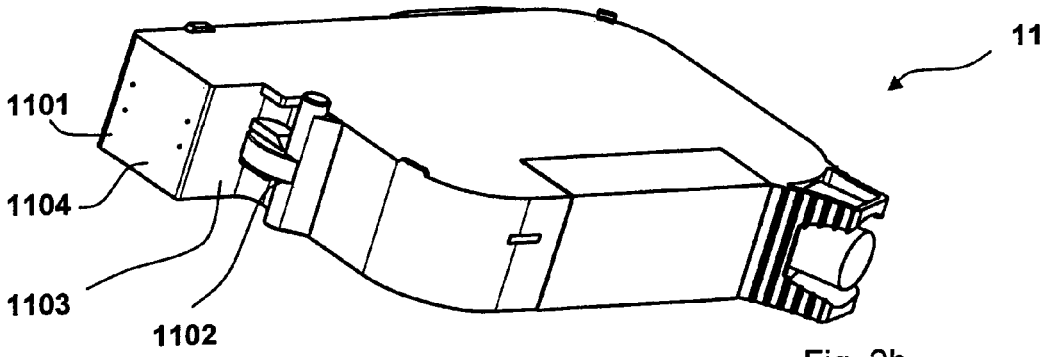
FIG. 2*b* is a perspective view, from the front lower left, of a modified HP ink cartridge that has been rotated 90° to the right and been tilted backwards.

FIG. 2*b* shows, from the front lower left, a perspective view of a modified HP ink cartridge that is rotated 90° to the right and tilted back so that the convex underside of the ink cartridge is better visible. The print head has a nozzle plate 1104 with the print head edge 1101 on the one side. A short and narrow neck side 1103 begins on the other side. The guide pin 1102 of the ink cartridge 11 is attached at the transition from the narrow neck side 1103 into the narrow convex underside. The pin consists of, for example, plastic or metal and centrally has a fixing nose that positively engages in the compartment of the ink cartridge molded on the neck projection, which compartment has a central rectangular or U-shaped opening accessible from the outside that accepts the hook-shaped end of the fixing nose.

Figure 2C:
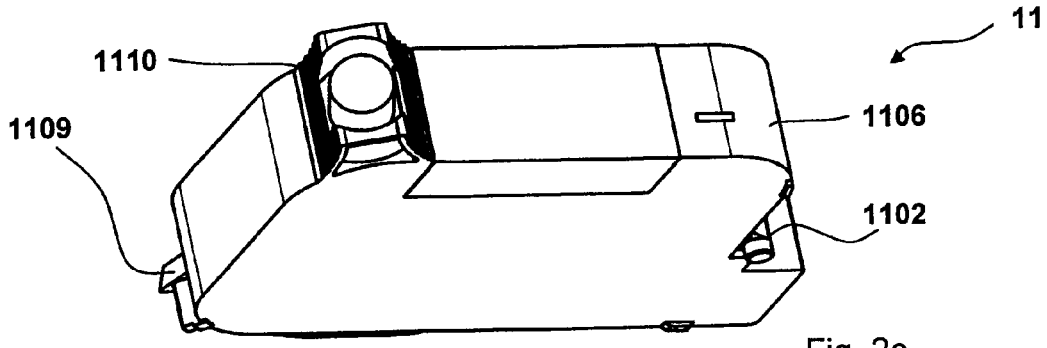
FIG. 2*c* is a perspective view, from the front upper left, of a modified HP ink cartridge that has been rotated 90° to the left.

FIG. 2*c* shows a perspective view of a modified HP ink cartridge from the front upper left that is rotated 90° to the left. On the prominent transitions of the narrow sides, the modified HP ink cartridge has in a known manner: a convexity 1106, a locking element 1109; and a grip element 110; as well as a guide pin 1102 in a novel and inventive manner.

Figure 3:
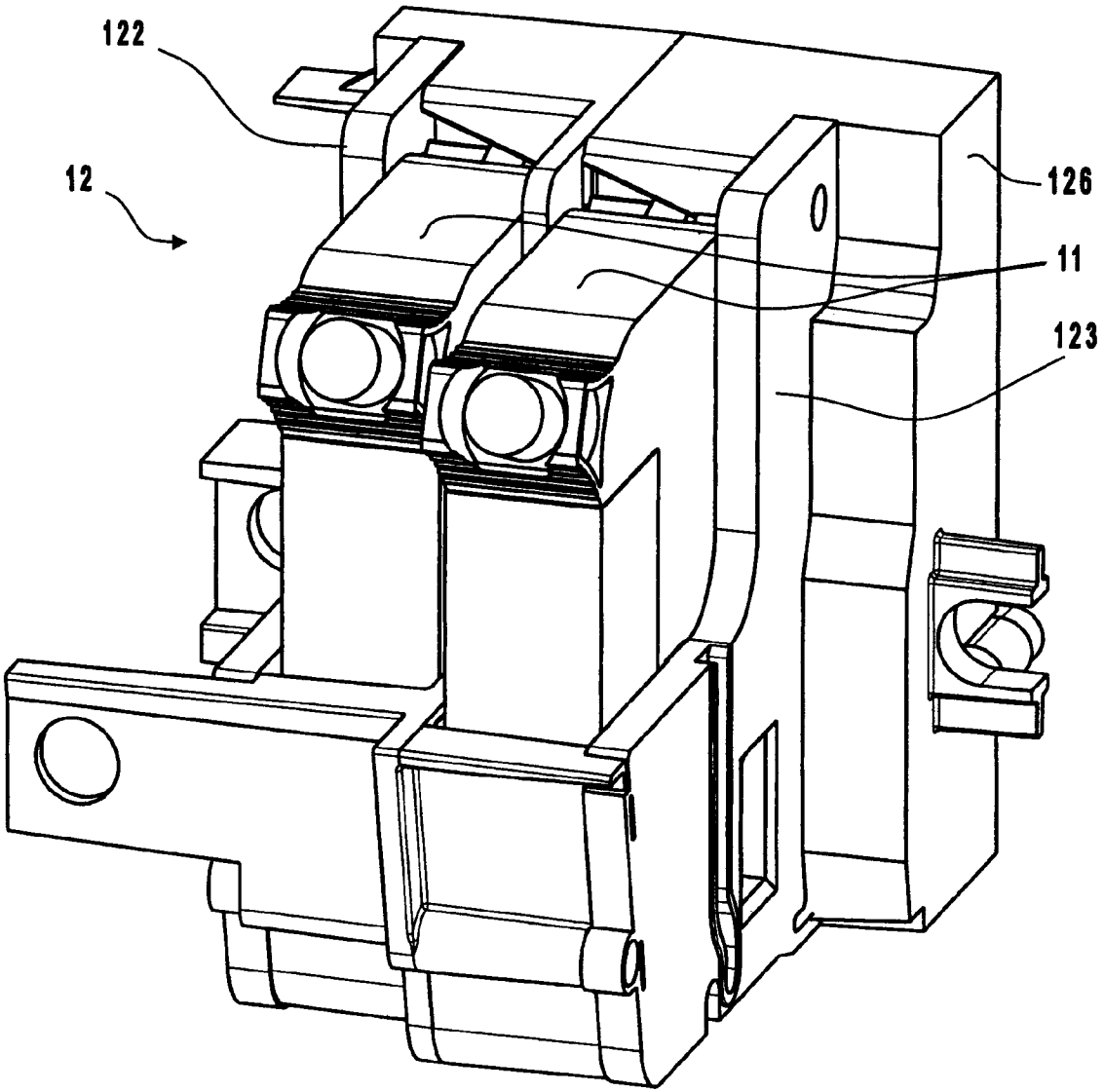
FIG. 3 is a perspective view, from the front upper right, of a modified carrier of the ink cartridge receptacle for the modified ½ inch HP ink cartridge.

FIG. 3 shows, from front upper right, a perspective view of a modified carrier of the ink cartridge receptacle for the modified ½ inch HP ink cartridges. The side walls 122 to the left and 123 to the right outwardly border two cavities in the carrier 126 of the ink cartridge receptacle 12 for the two modified ½ inch HP ink cartridges 11. The side walls and the carrier can be manufactured entirely from plastic. In the first case, an injection molding method is applied to generate the plastic part. The left and right side walls are advantageously identically formed. Both can also be manufactured from metal. In the latter case, a guide link can be shaped in the metal via milling. The guide pin of the second ink cartridge slides in the left side wall. The middle wall of the cartridge carrier consists of plastic and contains a guide link (cast in injection molding) in which the guide pin of the first ink cartridge slides.

At least the carrier should be manufactured from plastic. The invention can be used in a printing device that possesses no pivotable ink cartridge receptacle. The carrier 126 then possesses three bearing points for guidance and moving of the ink cartridge receptacle into an exchange or, respectively, printing position and, if necessary, into other positions. Draw hooks, tension springs and other mechanical means to exchange the HP ink cartridges 11 are foregone relative to the known variants shown in FIG. 1. The ink cartridge receptacle is thereby designed significantly simpler and less error-prone and is cheaper to manufacture than the receptacle 12* shown in FIG. 1.

Alternatively, the invention can naturally also be used in a printing device with a pivotable ink cartridge receptacle.

Figure 4:
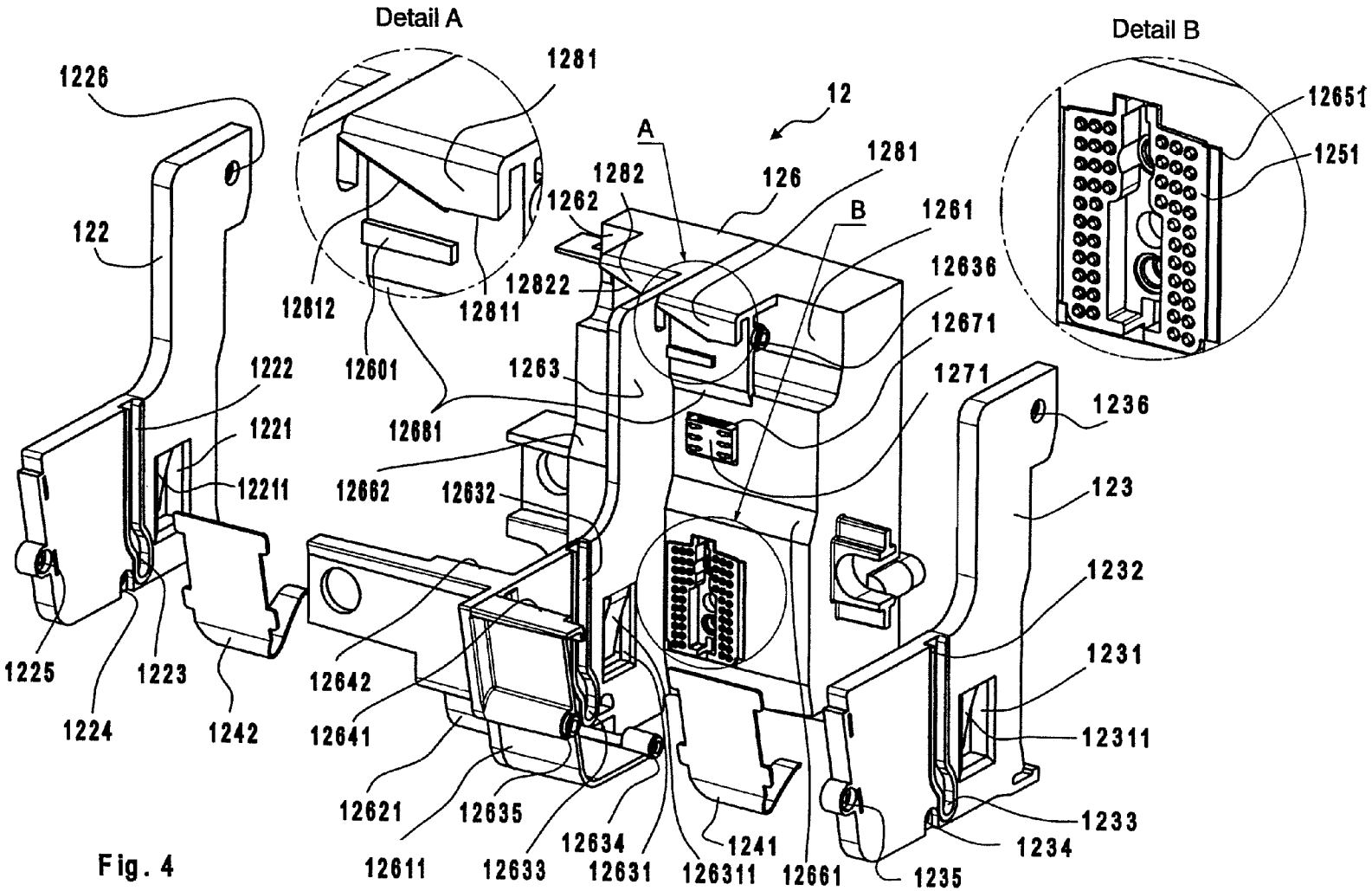
FIG. 4 is a perspective view, from the front upper right, of a modified ink cartridge receptacle in an exploded presentation.

FIG. 4 shows a perspective view of a modified ink cartridge receptacle from the front upper right in an exploded representation. The carrier 126 of the ink cartridge receptacle 12 possesses a middle wall 1263 to separate the cavity into two cavities that are matched to the shape of the ink cartridges. The two cavities are spaced apart from one another and arranged offset. The docking wall 1262 of the left half of the carrier 126 is arranged offset to the rear relative to the docking wall 1261 of the right half of the carrier 126. A locking nose is arranged and the transition from the narrow top side to the narrow back side of each ink cartridge, and the carrier 126 possesses a respective corresponding, hook-shaped locking element 1281, 1282 in the upper part that accepts the nose and thus locks the ink cartridge. A hook respectively projects upwards and forwards, and the hook end 12811, (and another hook end (not shown) in the other cavity) points downward in the direction of the nose of the ink cartridge. The locking element 1281, 1282 has an incline 12812, 12822 falling from the left side to the right side. Opposite the hook, a first stop 12601 is attached on a first step that rises beyond the docking wall 1261 in the direction of the ink cartridge. The step leads toward the center over a ramp 12681 to a first window in a trough. The locking element 1281 is shown enlarged as Detail A.

In the assembled state of the ink cartridge receptacle 12, a leaf spring 1241, 1242 that rests on the floor 12611, 12621 of the carrier 126 pushes the ink cartridge (not shown) upward with its elastic end so far that the locking nose of the ink cartridge engages with the locking element 1281, 1282.

A contact panel and a chip with six electrical contacts on its surface are arranged on the narrow back side of each ink cartridge. The carrier 126 possesses respective connectors 1251, 1252 and 1271, 1272 for contacting that are fashioned as a corresponding counterpart for the contact panel. Each connector 1251, 1252 for the contacts to control the inkjet print head is arranged in a second window 12651 (12652 is hidden) on a second step, wherein the second step has likewise been molded on a respective docking wall 1261, 1262, however near the floor of the ink cartridge receptacle 12. Connectors with elastic contact elements (what are known as pogo connectors) are used. The pogo connector of the connector 1251 (1252 is hidden) is presented magnified as Detail B and, for example, possesses 52 elastic contact elements. From the second step, the aforementioned trough in which a respective first window 12671 (12672 is hidden) is arranged is reached via a respective ramp 12661, 12662 towards the center. A connector 1271 (and a hidden connector in the other cavity) contacts the chip contacts and is arranged in the respective first window, and the peg connector of the connector 1271 (and the hidden connector) possesses 6 elastic contact elements.

The middle wall 1263 has the shape of the Latin letter 'd' and, in the bulged portion, has a window 12631 with an elastic tongue 126311, wherein the elastic force towards the left side is exerted to laterally press on an ink cartridge inserted into the left cavity. A threaded bore 12634 on the right (12644 to the left is hidden) and 12635 to the right (12645 to the left is hidden) as well as 12636 to the right (12646 to the left is hidden) are respectively arranged at the lower end of the floor 12611, 12621 of the carrier 126 and at the front side (as well as in the upper part) of the carrier 126. The floor 12611, 12621 of the carrier 126 respectively transitions into the front side, which possesses a respective second stop 12641, 12642 for the ink cartridge in the lower half of the carrier 126.

A straight guide 12632 running from top to bottom is introduced into the bulging part of the center wall 1263 on its right side, which guide ends in a bow-shaped part 12633 near the floor.

The right and left side walls 123, 122 likewise have the shape of the Latin letter 'd' and have a window 1231, 1221 with an elastic tongue 12311, 12211 in the bulged part. The elastic force of the right side wall 123 is directed towards the left side and is fashioned to laterally press on an ink cartridge inserted into the right cavity. A hole 1234 to the right, 1224 to the left and 1235 to the right, 1225 to the left as well as 1236 to the right, 1226 to the left are respectively arranged on the lower end of the right and left side walls 123, 122 and on their front sides, as well as in the upper parts. A straight guide 1232, 1222 running from top to bottom is introduced into the bulged part of the side wall 123, 122 on their right sides, which guide 1232, 1222 ends in a bow-shaped part 1233, 1223 near the floor.

Figure 5A:
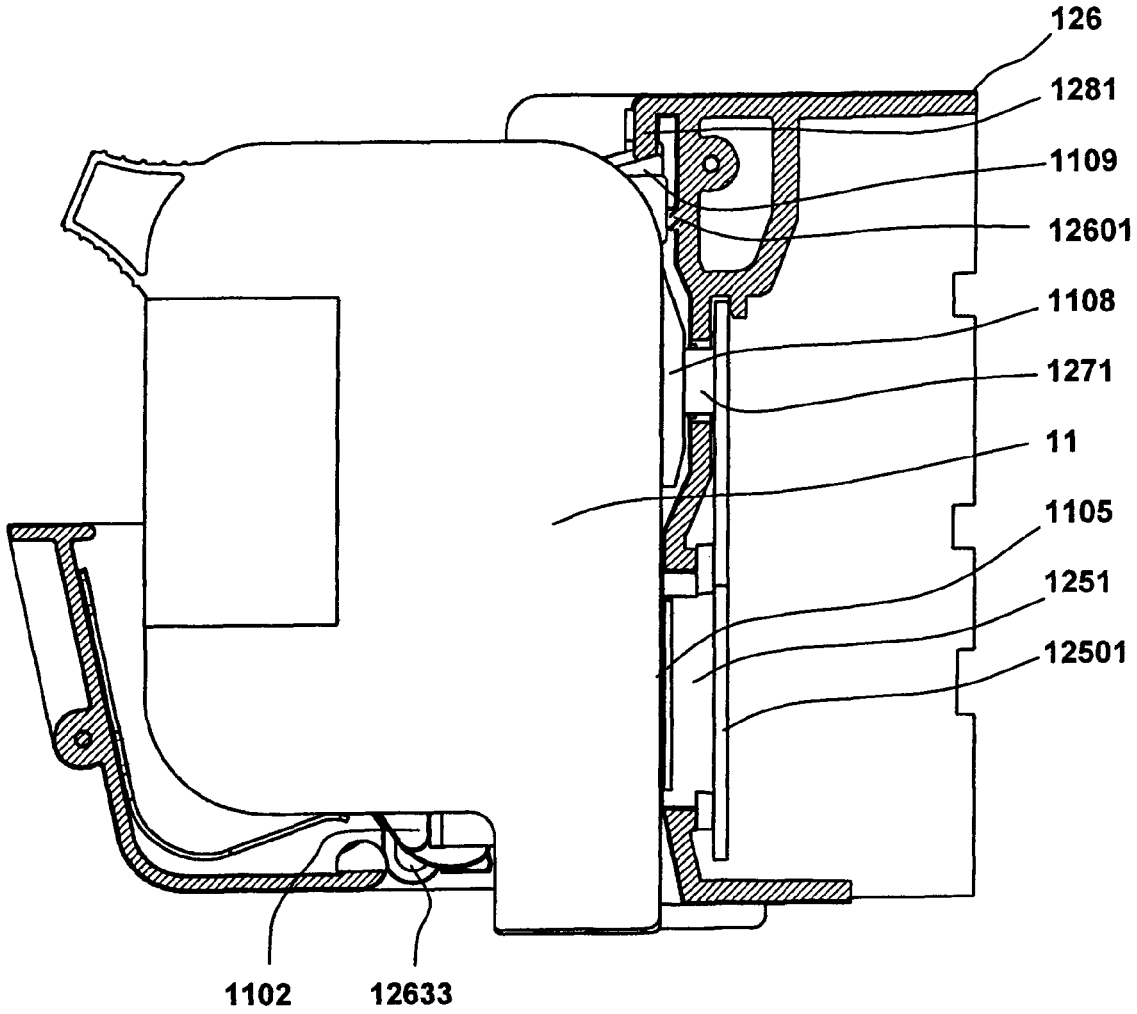
FIGS. 5*a, b, c* and *d* are sectioned side views of the ink cartridge receptacle in phases of the extraction of the ink cartridges.

FIG. 5*a* shows a sectioned side view of the ink cartridge receptacle according to the invention before the extraction of the ink cartridge, in a zero phase. This is thereby the same phase as was shown in FIG. 1. In FIG. 5*a*-5*d* the housing of the ink cartridge receptacle is presented orthogonal to the nozzle plate of a cartridge and orthogonal to the contact surface of the two connectors 1251, 1271. The connectors 1251, 1271 are mechanically fastened and electrically contacted to a circuit board 12501 inside the ink cartridge receptacle and aligned on the cavity for the insertion of the ink cartridge 11. The circuit board and connectors were not shown in section. The connectors contain elastic contact elements (not visible) on which the contacts of the ink cartridge are pressed (due to the link guide) when the bow-shaped part 12633 at the lower end of the link guide is traversed by the guide pin 1102. A contacting unit 1105 and a chip mount 1108 with a chip (not visible in the side view are arranged on the narrow back side of the ink cartridge, the contacts of which chip are correctly contacted when the locking nose 1109 engages with the hook-shaped locking element 1281 arranged in the upper part of the carrier 126. If both ink cartridges are properly inserted into the carrier, the locking nose 1109 of the narrow back side of each ink cartridge then rests on a respective first stop 12601 of the carrier 126.

Figure 5B:
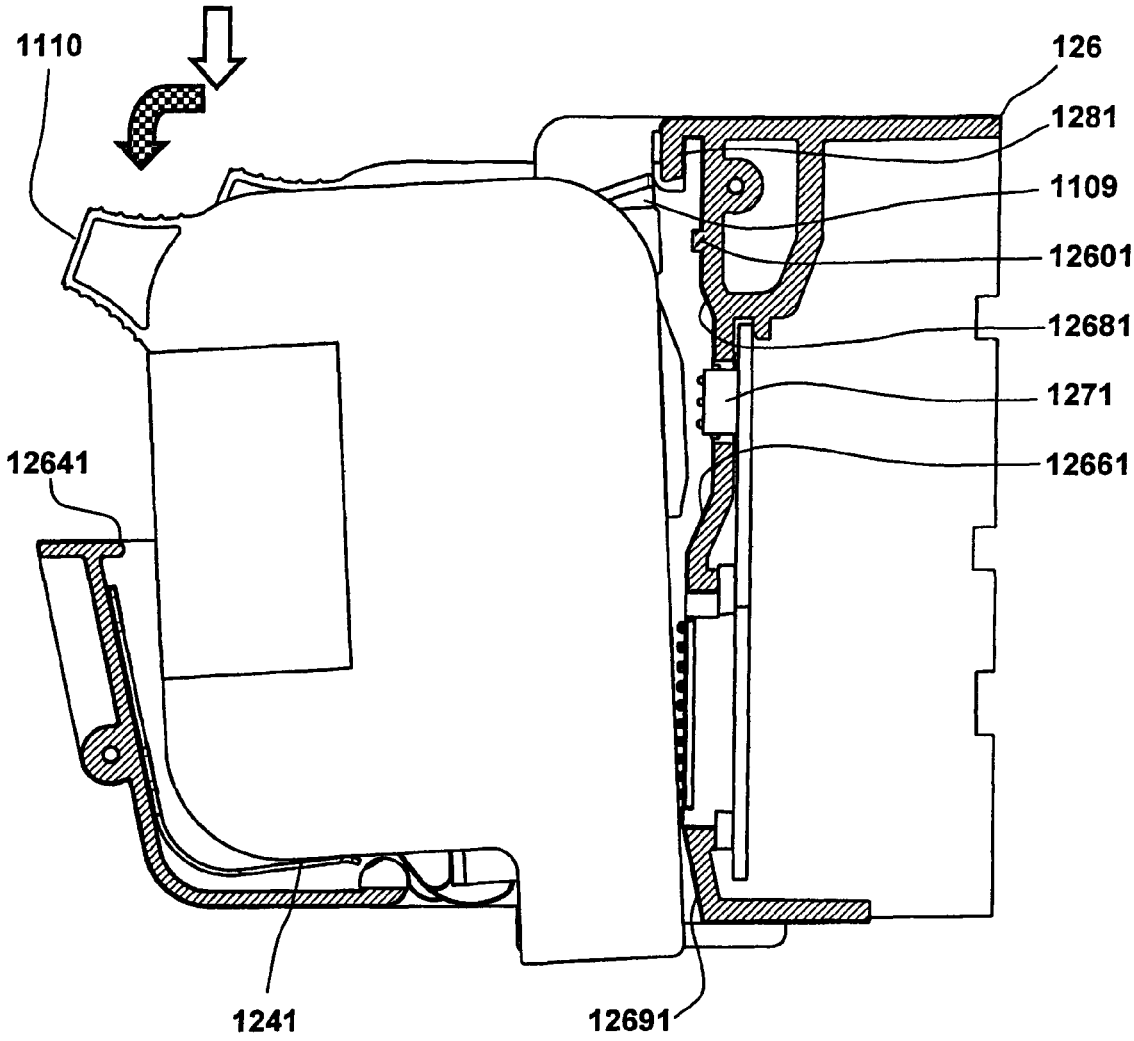

FIG. 5*b* shows a sectioned side view of the ink cartridge receptacle according to the invention in a first phase of the extraction of the ink cartridge. For this a force is manually exerted (not shown) on the grip element 1110 in the ink discharge direction (see white arrow) and counter to the elastic force of the leaf springs 1241, wherein the locking nose 1109 disengages with the hook-shaped locking element 1281 arranged in the upper part of the carrier 126. Via a forward tilting motion (see patterned arrow), the stop 12601 is abandoned and the contacts (initially of the connector 1271 for the chip contacts) are thereby broken [disconnected]. The connector is arranged in a trough that leads upward via a first ramp 12681 to the first step and that leads downward via a second ramp 126681 to the second step, which steps are molded on the docking wall. The forward tilting motion is on the one hand bounded by the second step 12641 and on the other hand by a third ramp 12691 that is arranged in the lower part of the carrier 126 and forms a third stop.

Figure 5C:
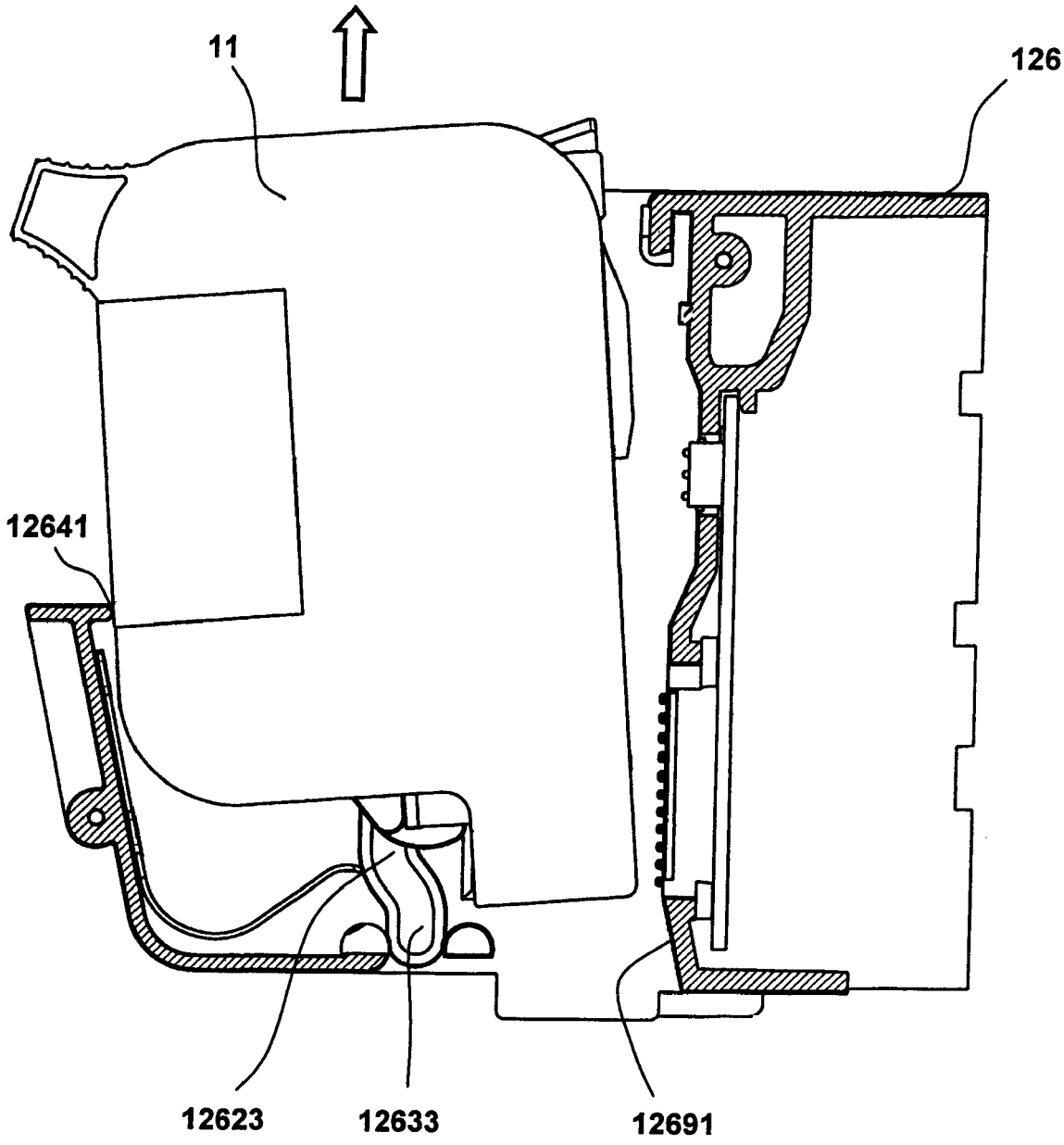

FIG. 5*c* shows a sectioned side view of the ink cartridge receptacle according to the invention in a second phase of the removal of the ink cartridge. In said second phase the ink cartridge 11, due to upward motion driven by elastic force, is directed—via the link guide in the bow-shaped part 12633—sufficiently far away from the third ramp 12691 (i.e. the docking wall) and thus also from the contacts of the connectors. A second stop 12641 (12642 not shown) for the narrow front side if the ink cartridge is respectively molded on the front side of the carrier 126. The second stop and the guide 12623 prevent the ink cartridge 11 from rotating too far downward when the ink cartridge is drawn upward in the exchange (see white arrow).

Figure 5D:
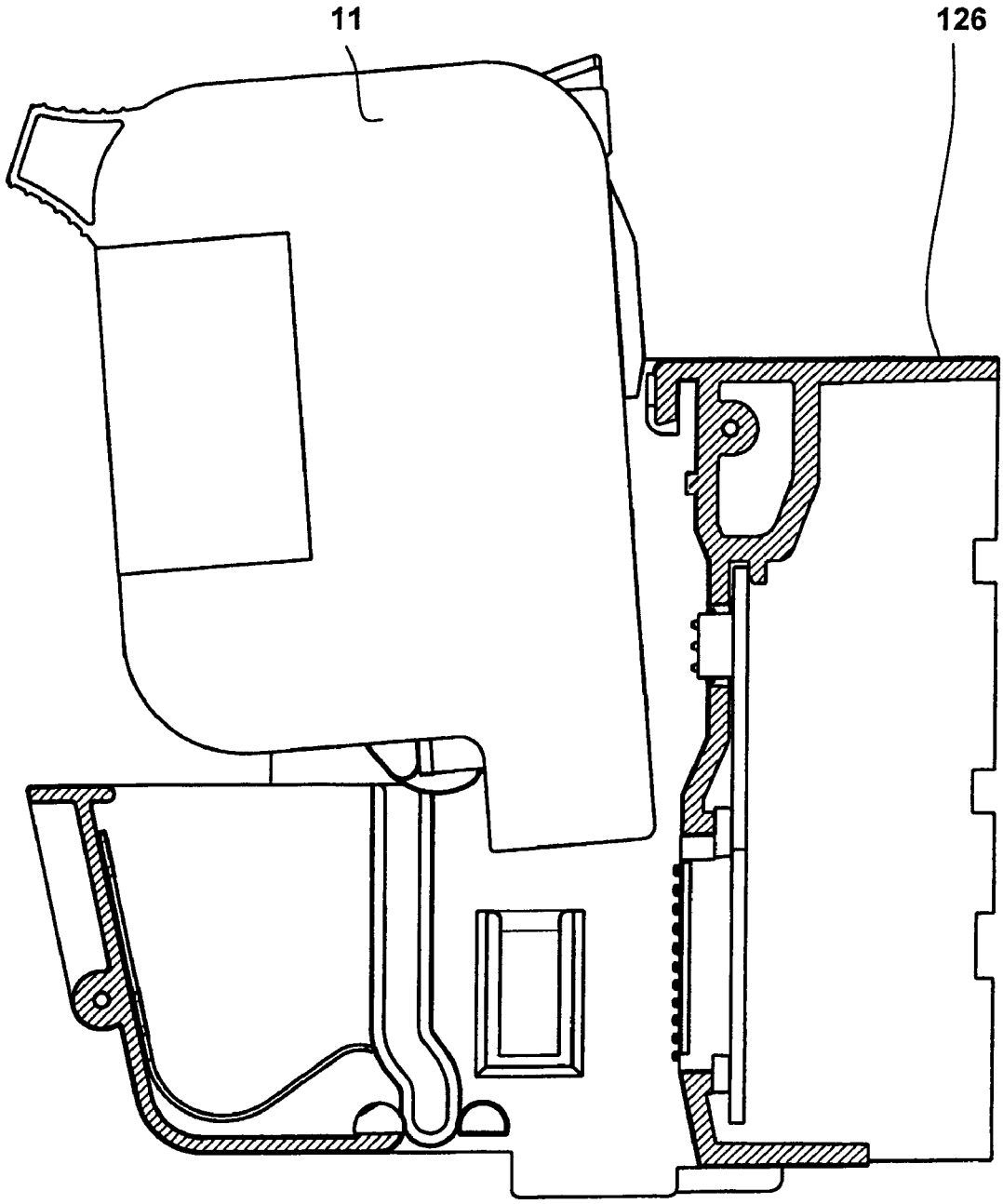

FIG. 5*d* shows a sectioned side view of the ink cartridge receptacle according to the invention in a third phase of the extraction of the ink cartridge. In the third phase, the ink cartridge 11 leaves the movement region in the ink cartridge receptacle that is guided by the carrier 126.

The ink cartridge receptacle is advantageously identically constructed in the region of both cavities for both ink cartridges.

The invention can be used in a different, alternative ink cartridge receptacle than was described in the preceding. For example, a franking machine with printing carriage by means of which a print head can be moved from the printing position into an exchange position was described in the European Patent EP 1 300 807 B1. The printing carriage would merely have to be adapted to the modified ink cartridges.

The invention can also be used in a printing device that possesses a pivotable ink cartridge receptacle or in which the ink cartridge receptacle is moved during the printing.

The invention is not limited to the present embodiments. Ink cartridges of a different manufacturer can clearly also be modified and used. The attachment of the guide pin on the ink cartridge can alternatively ensue by means of a ultrasound welding connection, bolt, rivet or staple connection.

Although modifications and changes may be suggested by those skilled in the art, it is the intention of the inventor to embody within the patent warranted hereon all changes and modifications as reasonably and properly come within the scope of his contribution to the art.

I claim as my invention:

1. An ink jet printing system comprising:

an ink cartridge comprising an ink jet print head and a cartridge body having two flat side walls and a front side comprising a nozzle plate of the ink jet print head, a back side orthogonal to said nozzle plate, said ink jet print head comprising an edge disposed between said nozzle plate and said back side and having a neck that transitions into a convex underside of the ink jet print head, said backside transitioning through a transition region to a topside of said cartridge body, a locking nose located in said transition region, said topside transitioning, through a further transition region, into a front side of said cartridge body, a gripping element located at said further transition, said front side transitioning through a convexity into a convex side, a parallel interface disposed at said edge, said interface comprising an electrically contacting unit for controlling operation of said ink jet print head, and a chip mount located above said contacting unit and containing an integrated circuit chip therein, and a guide pin fastened between said convexity and a head of the cartridge body, and a guide pin connection between said convexity and said head of said ink cartridge, said guide pin terminating at one flat sidewall of said ink cartridge, and projecting beyond said flat sidewall at an opposite side;

a printing arrangement that generates a relative movement between said ink jet print head and a print item;

said printing arrangement comprising a cartridge receptacle, in which said ink cartridge is received, said cartridge receptacle comprising a shaft-shaped cavity with a carrier and external walls; and at least one of said walls of said cartridge receptacle, which borders said shaft-shaped cavity having a guide link and a stop configured to receive said guide pin therein said guide link being configured to force said guide pin therein to follow a predetermined path upon removal of said ink cartridge from said cavity, and this also causing said convexity of said ink cartridge to follow said predetermined path during said removal.

2. An ink jet printing system as claimed in claim 1 wherein said guide pin connection is an ultrasound welded connection.

3. An ink jet printing system as claimed in claim 1 wherein said guide pin connection is an adhesive connection.

4. An ink jet printing system as claimed in claim 1 comprising a compartment located in a transition between said neck and said convex bottom, said guide pin connection being located in said compartment.

5. An ink jet printing system as claimed in claim 4 wherein said stop is molded in said compartment and wherein said compartment is narrower than said convex bottom.

6. An ink jet printing system as claimed in claim 1 wherein said print head faces downwardly for insertion into a matching receptacle.

* * * * *